US005357088A

United States Patent [19]

Suzuki et al.

[11] Patent Number: 5,357,088

[45] Date of Patent: Oct. 18, 1994

[54] METHOD FOR MELTING A PHOTOGRAPHIC COMPOSITION GEL TO A SOL USING MICROWAVE ENERGY

[75] Inventors: Shinichi Suzuki; Hideaki Kimura, both of Hino; Kazuyoshi Ichikawa, Tokyo; Sanae Oyama, Hachioji, all of Japan

[73] Assignee: Konica Corporation, Tokyo, Japan

[21] Appl. No.: 878,417

[22] Filed: May 4, 1992

[30] Foreign Application Priority Data

May 9, 1991 [JP] Japan ..... 3-104338

[51] Int. Cl.[5] ..... H05B 6/54; G03C 1/02

[52] U.S. Cl. ..... 219/772; 219/774; 219/762; 219/736; 219/702; 430/130

[58] Field of Search ..... 219/10.55 R, 10.55 B, 219/10.55 M, 10.55 F, 10.55 E, 10.55 A, 10.81, 678, 679, 703, 687, 702, 736, 745, 750, 762, 774, 770, 772; 430/130, 136

[56] References Cited

U.S. PATENT DOCUMENTS

| | | | |
|---|---|---|---|
| 2,602,134 | 7/1952 | Nelson | 219/10.55 E |
| 3,553,413 | 1/1971 | Soulier | 219/10.55 A |
| 4,004,122 | 1/1977 | Hallier | 219/10.55 A |
| 4,114,011 | 9/1978 | Stubbs | 219/10.55 M |
| 4,353,890 | 10/1982 | Scott | 219/10.55 B |
| 4,567,340 | 1/1986 | Latchum, Jr. | 219/10.55 A |
| 4,673,782 | 6/1987 | Koepke et al. | 219/10.55 M |

FOREIGN PATENT DOCUMENTS

| | | |
|---|---|---|
| 0174587 | 3/1986 | European Pat. Off. . |
| 889260 | 9/1953 | Fed. Rep. of Germany . |
| 169743 | 10/1982 | Japan . |
| 100439 | 5/1988 | Japan . |

*Primary Examiner*—Philip H. Leung

*Attorney, Agent, or Firm*—Finnegan, Henderson, Farabow, Garrett & Dunner

[57] ABSTRACT

A method for making a photographic composition gel ready for use in production from a good preservative frozen state, causing no change in photographic properties, wherein a photographic composition gel is melted to a sol by placing a light shielding dielectric preservative container holding lumps of a photographic composition gel in a dielectric heating apparatus which generates high frequencies capable of penetrating to a depth corresponding to the size of the above photographic composition gel lumps, and melting the photographic composition gel to a sol by irradiating the lumps of gel with the above high frequencies from the outside of the container.

11 Claims, 2 Drawing Sheets

METHOD FOR MELTING A PHOTOGRAPHIC COMPOSITION GEL TO A SOL USING MICROWAVE ENERGY

FIELD OF THE INVENTION

The present invention relates to a method for melting a low-temperature preserved photographic composition gel containing a hydrophilic colloid, particularly gelatin, to a sol and more specifically to a production engineering measure to melt such a gel to a sol.

BACKGROUND OF THE INVENTION

Manufacture of a silver halide photographic light-sensitive material usually comprises preparation of photographic compositions and treating processes thereof as described below. As a hydrophilic colloid used in a light-sensitive material, gelatin is mainly used at the present time.

(1) 1st ripening: formation of a silver halide colloidal composition called a photographic emulsion commonly, which is comprised of a gelatin sol containing silver halide grains suspended in it.

(2) Desalting.

(3) 2nd ripening: chemical ripening.

(4) Preparation of a coating solution.

A photographic coating solution is prepared by adding additives necessary for proper photographic properties to a photographic emulsion, which has undergone the 2nd ripening, and adjusting its solution properties such as concentration and viscosity required in coating. In the addition of oil-soluble additives such as couplers or development inhibitor releasing compounds (DIR) to a color light-sensitive material, these are generally dissolved first in a high boiling solvent and dispersed in a hydrophilic colloid, then the dispersion prepared is added to a photographic emulsion.

(5) Coating, cooling to a gel and drying: the coating solution sol prepared is coated on a support, cooled to set and dried to a xerogel.

In the industrial production of light-sensitive materials, a photographic emulsion and the above composition related thereto are preserved for a given period of time in the above manufacturing processes for reasons of factory operation and quality control of products. Such preservation is generally applied to photographic compositions such as a dispersion, a photographic emulsion after desalting or the 2nd ripening, and a coating solution freshly prepared for use.

Among these steps, preservation of a coating solution has advantages (1) that it makes possible to examine a coating solution itself in the course of preservation, and thereby the solution's photographic properties can be confirmed before coating, (2) that deterioration in photographic properties of a coating solution due to a prolonged standing can be prevented because only a dissolving process is needed as the preliminary arrangement for coating, this lessens the load in operation and installation, and (3) that a large amount of a uniform coating solution can be prepared at a time only by blending preserved emulsions. Similar advantages can also be brought out by preservation of a photographic emulsion or a dispersion, and requirements for an improved productivity and a high functional reliability can be met with the enlargement of manufacturing scale and rise in coating speed of light-sensitive materials.

However, there often arise various problems which impair functions of those compositions during the preservation or by sol-gel transformation. The preservation of these compositions has so far been usually practiced by chilling or freezing them in order to avoid the deterioration attributable to the progress of chemical reactions or the propagation of microorganisms caused during the preservation.

Such low-temperature preserved photographic compositions are each dissolved and blended by a necessary amount at the time of adjusting conditions of a coating solution, but these photographic compositions have usually undergone many changes of state up to that time.

That is, a photographic composition is in a sol state when prepared freshly, and then it undergoes changes of state such as gellation (setting to jelly) by low temperature preservation, dehydration and transformation into coagel (cryohydrate gel) by refrigeration and freezing, gellation through thawing, transformation into a sol by dissolution on heating, gellation by coating and cooling, and transforming into a xerogel by drying. While the state changes in succession as mentioned above, the composition is subjected to severe changes such as syneresis and dispersion of the contents and aggregation of the suspended particles due to the approach and contact thereof, as the structure or volume of gelatin micells changes. As a result, functions possessed by the composition before the preservation cannot be fully recovered in many cases.

Such thawing and dissolving of the composition has so far been practiced by placing it in a warm dissolving water, followed by stirring. But Japanese Pat. O.P.I. Pub. No. 193134/1990 recommends natural thawing in a refrigerator of 0° to 7° C. In any case, however, a prolonged preservation under a melting condition at above 0° C. gradually deteriorates properties of the composition, and natural thawing over a long time spoils the readiness in production engineering.

As techniques to melt a preserved photographic composition gel from the standpoint of production engineering, Japanese Pat. O.P.I. Pub. No. 100439/1988 proposes a method which comprises the steps of placing a composition gel in a melting tank, stirring it while continuing conductive heating from the tank wall, and successively taking a melted sol out of a separating outlet which separates the melted sol from the unmelted gel. And Japanese Pat. O.P.I. Pub. No. 169743/1982 proposes a method which comprises the steps of tilting a container holding a composition gel, irradiating the surface of the gel with radiowaves from a waveguide to melt the gel to a sol continuously from its surface, and taking the sol out the tilted container by allowing the sol to pass under a microwave shielding plate which advances in accordance with the retrogression of the gel surface.

However, the former requires the processes of taking a composition gel out of a preserving container, cutting the composition gel into pieces, feeding thereof, cleaning melting tanks of respective emulsions and the installation of the same number of melting tanks as that of emulsions used. The latter requires a tilt-setting apparatus and related work as well as a careful shielding work with a microwave shielding plate, in addition, this has an disadvantage of low efficiency attributable to a low melting speed to a sol.

The object of the present invention is to provide a method for melting a photographic composition gel to a sol at a high productivity, without changing the photographic properties.

a (side view)
b (front view)
1. Dielectric heating apparatus
2. Light shielding dielectric preservative container
3. Belt conveyor
4. Shutter for the container put-in/take-out
5. Electrode
6. Electricradiowave oscilator

DETAILED DESCRIPTION OF THE INVENTION

The above object of the invention is achieved by a method for preparing a photographic composition gel which comprises the processes of placing a light shielding dielectric preservative container holding lumps of a photographic composition gel in a dielectric heating apparatus which generates high frequencies capable of penetrating to a depth corresponding to the size of the above photographic composition gel lump, and melting the photographic composition gel to a sol by irradiating the above high frequencies from the outside of the container.

The photographic composition gel, means a photographic emulsion, silver halide grains dispersed in a hydrophilic colloid (generally, a gelatin) or, an emulsion secondly ripened and spectrally sensitized. In case of color photographic material, oil-soluble additives such as couplers etc. being solved in a high boiling solvent and dispersed in a hydrophilic colloidal solution. Furthermore, a gelatin-additive-liquid which is an additive for amelioration of photographic characteristics and/or coatability, dispersed in a hydrophilic colloidal solution; and the above mentioned photographic emulsion and the gelatin-additive-liquid mixed with the photographic emulsion. The temperature of the critical point at which a gelatin solution changes the state to sol or gel is about 30° C., depends on the concentration of the gelatin and salts in the solution.

In embodying the invention, it is preferable that high frequency electrodes of the dielectric heating apparatus be arranged in parallel at an interval wide enough to accommodate the shading dielectric preservative container between them. As a result, the carrying-in and carrying-out work can be easily performed, and in addition to that, plural containers respectively holding composition gels can be handled continuously. Further, plural pairs of high frequency electrodes may be installed.

Figure 2:
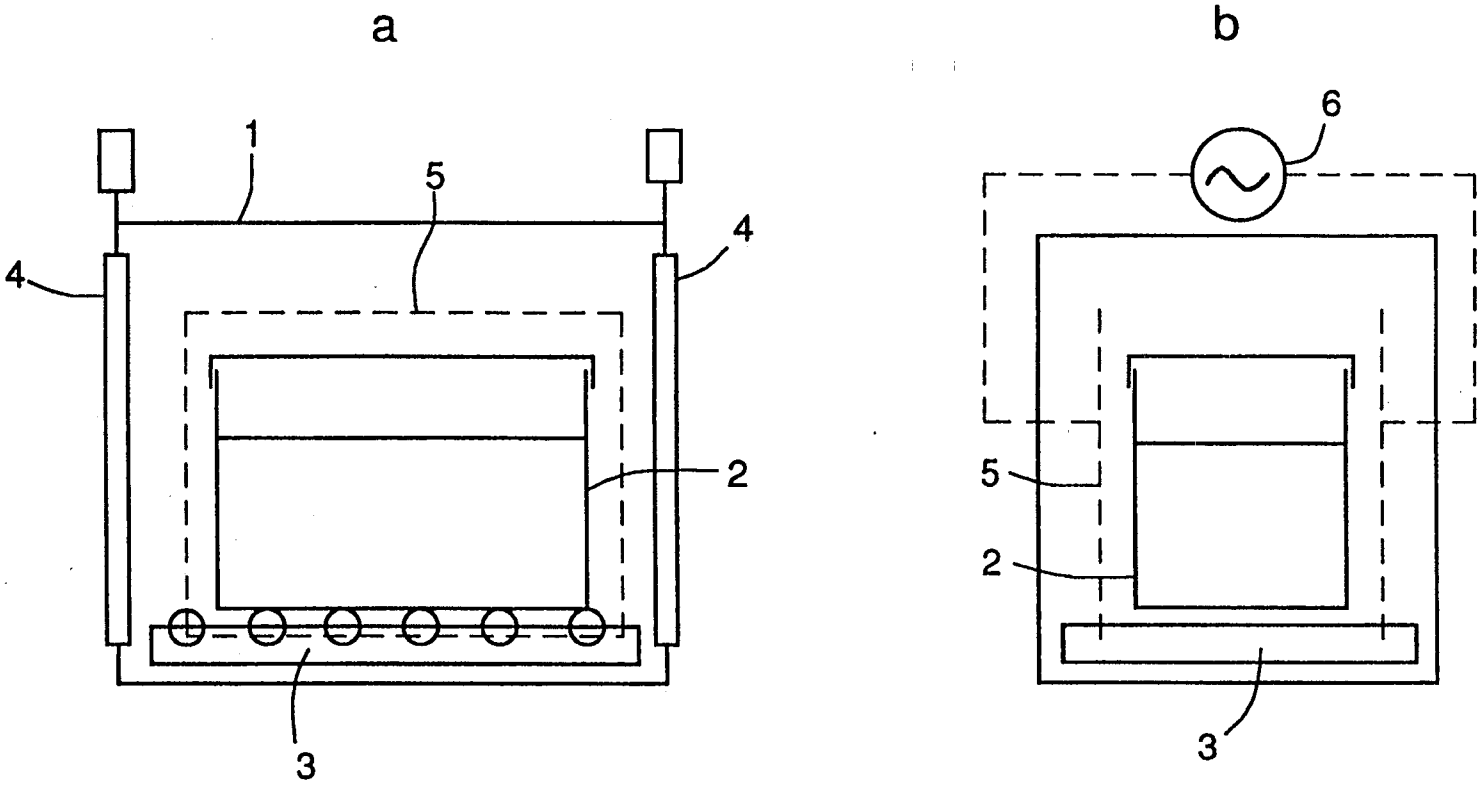
FIG. 2 is showing the apparatus for the method of the invention.

The parallel electrode plates preferably locate perpendicularly standing in the container, rather than upper and lower positions. By setting the electrodes like this, the melting process time can be settled constant, even if the volume of the processing liquid varies. Furthermore, as illustrated in FIG. 2*a* and *b*, the container used in this invention preferably has a flat shape for the purpose of faster melting, i.e. the thickness of the container, as the direction for a spacing for the electrodes is shorter than the lengths of edges of the electrode plates.

The frequency of the high frequency used is preferably at least 2450 MHz for composition gel lumps whose sizes measured as the thickness between the electrode plates, are 2.5 cm or less; for lumps having sizes more than 2.5 cm, it is preferably 10 to 30 MHz and especially 13.56 MHz in practical use.

The main point of the invention is to melt a composition gel in a container to a sol together with the container by irradiating high frequencies having high penetrabilities.

The relation between the penetrability and the frequency of a high frequency is expressed by the following half-power depth D(m), which usually expresses a penetrability of an electromagnetic wave.

$$D \approx 3.32 \times 10^7/(f\sqrt{\epsilon r} \cdot \tan\delta)$$

wherein f is frequency (Hz); $\epsilon r$, dielectric constant; $\delta$, dielectric loss angle. $\epsilon r$ and $\delta$ are the characteristic values to substances, therefore, the frequency is inversely proportional to the thickness of the gel lumps.

The high frequency irradiation method of the invention makes it possible for a photographic composition gel to be efficiently melted to a sol in a short time even in the light, and thereby a high productivity is attained.

A photographic emulsion according to the invention can use conventional silver halides such as silver bromide, silver chloride, silver iodobromide and silver chlorobromoiodide. For a silver halide emulsion according to the invention, formation of silver halide grains, desalting and chemical ripening are not particularly limited in conditions and can be carried out according to methods known in the art.

Further, a chemically ripened emulsion can be subjected to spectral sensitization by use of a conventional sensitizing dye. In addition, various conventional photographic additives, such as a stabilizer, sensitizer, controlling agent and antistain agent, may be arbitrarily added to prepare a coating solution.

The compositions according to the invention, such as the above dispersion, photographic emulsion and coating solution, are chilled for low temperature preservation. In general, a preserving temperature higher than 0° C. is not appropriate to prevent increase in fog, deterioration in photographic properties of an emulsion including change in sensitivity, and propagation of microorganisms, moreover, dispersed oil droplets containing additives become coarse, and thereby pin holes are liable to occur. Accordingly, it is preferable that the composition be chilled rapidly. For example, there can be employed the method for rapidly chilling a composition in a sol state to a gel by boiling the sol under reduced pressure to deprive the latent heat of vaporization, as is described in Japanese Pat. O.P.I. Pub. No. 104937/1985.

This low-temperature preserved composition gel can be melted to a sol according to the method of invention as occasion arises and made up into a coating solution, which is then coated on a support and dried. Conventional supports and coating methods can be used to perform the coating.

EXAMPLES

The present invention is hereunder described in detail with the examples.

Example 1

Figure 1:
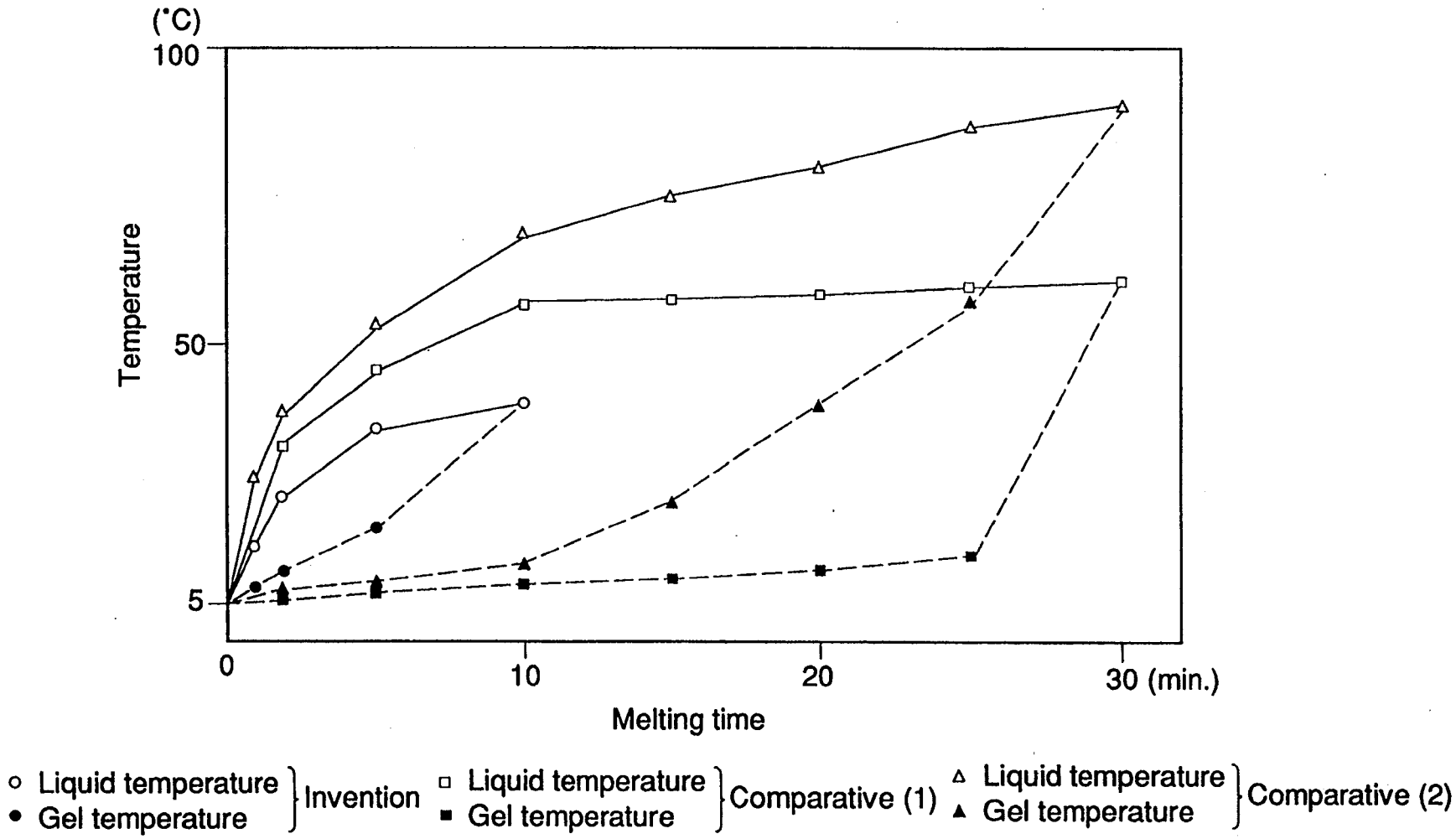
FIG. 1 is a graph showing temperature histories of gels and sols in the melting process from gel to sol with high-frequency irradiation.

There was preserved, in a refrigerator kept at 5° C., 50 l of the following photographic emulsion placed in a 50 cm diameter × 35 cm high cycindrical polypropylene shading container. Then, it was carried in a dielectric heating apparatus having in upper and lower positions together with the container and melted to a sol at 13 MHz. The changes in internal temperature of the gel and temperature of the melted sol are shown in FIG. 1. Further, the viscosity and photographic properties of the sol were examined, the results are shown in FIG. 1. Measurement of the viscosity was made at 40° C. with a Brook field type viscometer, the gel temperature and the sol temperature were measured by inserting an ordinary resistance temperature sensor.

Silver Halide Emulsion

A core/shell type silver iodobromide emulsion comprised of grains having an average grain size of 0.38 μm was prepared by the double jet method. After desalting in a usual manner, the emulsion was chemically ripened with sodium thiosulfate and chloroauric acid so as to give an optimum sensitivity. The above emulsion prepared in a sol state was spectrally sensitized to green-sensitivity with the addition of sensitizing dyes I and II in amounts of $5\times10^{-4}$ mol and $1\times10^{-4}$ mol, respectively, per mol of silver contained in the emulsion.

Then, a coupler dispersion of the following recipe was added to the emulsion so as to give a magenta coupler content of 0.5 g, and a colored magenta coupler content of 0.01 g, per gram of silver contained in the emulsion.

| Coupler dispersion | |
|---|---|
| M-1 | 7.5 g |
| CM-1 | 0.15 g |
| Tricresyl phosphate | 6 g |
| 4% gelatin solution | 375 ml |
| Dispersing aid Su-1 (10% solution) | 25 ml |

The following additives were further added thereto, and a coated sample was prepared by use of a coating solution so obtained.

| Additives | |
|---|---|
| Thickener V-1 | 4% solution was added to make the viscosity 32 cp. |
| Coating aid Su-1 | 1.2 ml of 1% solution was added per 200 ml of the emulsion. |

The coated sample was exposed in a usual manner, processed in the conditions described later and examined for the specific sensitivity and the specific fog. The results are shown in Table 1.

Sensitizing dye I

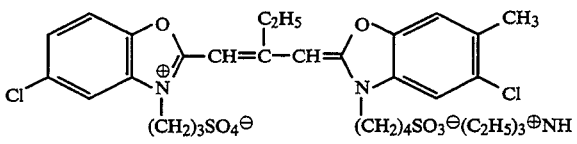

Sensitizing dye II

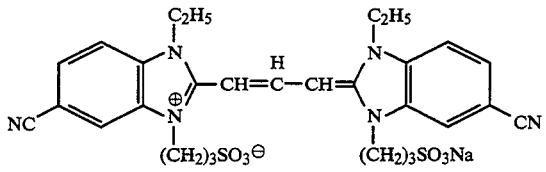

M-1

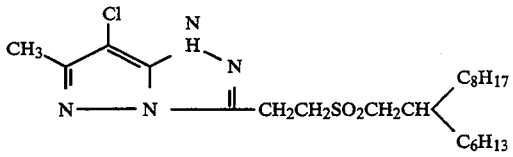

CM-1

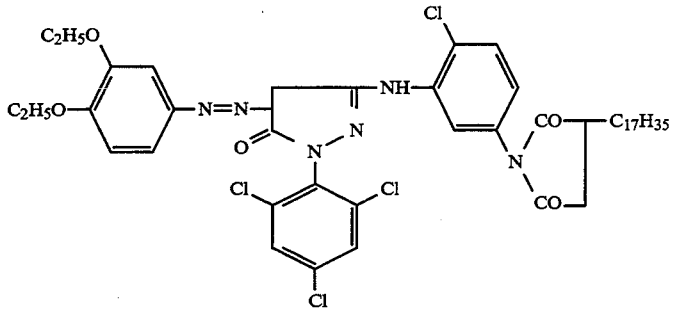

Su-1

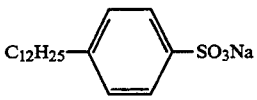

Su-2

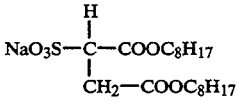

V-1

-continued

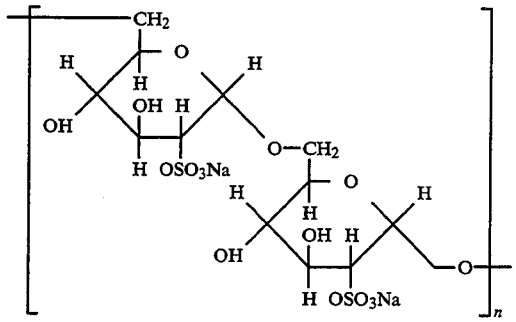

Comparative Example (1)

The photographic emulsion gel preserved as in Example 1 was taken out of the container in an amount corresponding to 50 l. Then, it was cut into lumps of approximately 20 cm square, placed in a jacketed melting kettle together with 15 l of water, and melted by heat conduction while feeding warm water of 75° C. to the jacket. The histories of the internal temperature of the unmelted gel and the melted sol temperature in this melting process are shown in FIG. 1. In addition, the viscosity and the photographic properties after the melting were measured as summarized in Table 1.

Comparative Example (2)

A gel having the same form as in Example 1 was melted to a sol in a similar procedure as above using a microwave heating apparatus which generates a high frequency of approximately 2450 MHz. The histories of the internal gel temperature and the melted sol temperature were measured as shown in FIG. 1. Further, the sol was restored to the prescribed liquid volume, then its viscosity and photographic properties were examined. The results are shown in FIG. 1.

Example 2

Approximately 500 ml of the above photographic emulsion was placed in a 13 cm×20 cm×2 cm (thickness) polyethylene container and preserved in the same manner as in Example 1. Then, it was melted to a sol together with the container in the microwave heating apparatus used in Comparative example (2). The sol was restored to the prescribed liquid volume, then its viscosity and photographic properties were examined as summarized in FIG. 1.

Each of the above coated samples was wedgewise exposed using a sensitometer and processed, then its sensitivity and fog were measured. The processing conditions were as follows: [Processing solutions and processing conditions]

| Processing (at 38° C.) | |
|---|---|
| Color developing | 3 min 15 sec |
| Bleaching | 6 min 30 sec |
| Washing | 3 min 15 sec |
| Fixing | 6 min 30 sec |
| Washing | 3 min 15 sec |
| Stabilizing | 1 min 30 sec |
| Drying | |

Composition of a processing solution used in each process is as follows:

| Color developer | |
|---|---|
| 4-Amino-3-methyl-N-(β-hydroxyethyl)aniline sulfate | 4.75 g |
| Anhydrous sodium fulfite | 4.25 g |
| Hydroxylamine ½ sulfate | 2.0 g |
| Anhydrous potassium carbonate | 37.5 g |
| Potassium bromide | 1.3 g |
| Trisodium nitrilotriacetate monohydrate | 2.5 g |
| Potassium hydroxide | 1.0 g |

Water was added to make 1 liter, and the pH was adjusted to 10.02.

| Bleacher | |
|---|---|
| Ammonium ferric ethylenediaminetetracetate | 100.0 g |
| Diammonium ethylenediaminetetracetate | 10.0 g |
| Ammonium bromide | 150.0 g |
| Glacial acetic acid | 10.0 g |

Water was added to make 1 liter, and the pH was adjusted to 6.0 with aqueous ammonia.

| Fixer | |
|---|---|
| Ammonium thiosulfate | 175.0 g |
| Anhydrous ammonium sulfite | 8.6 g |
| Sodium metasulfite | 2.3 g |

Water was added to make 1 liter, and the pH was adjusted to 6.0 with acetic acid.

| Stabilizer | |
|---|---|
| Formalin (37% aqueous solution) | 1.5 ml |
| Koniducks (made by Konica Corp.) | 7.5 ml |

Water was added to make 1 liter.

TABLE 1

| Property | Reference (before preservation) | Example 1 | Comp. example (1) | Comp. example (2) | Example 2 |
|---|---|---|---|---|---|
| Viscosity (cp) | 20 cp | 20 cp | 15 cp | 14 cp | 20 cp |
| Specific fog | 100 | 100 | 118 | 127 | 100 |
| Specific sensitivity | 100 | 100 | 91 | 86 | 99 |

As apparent from Table 1, the sample according to the invention exhibited the same properties as the reference sample which was not preserved. In the comparative samples, however, increase in fog, decrease in viscosity and a tendency to desensitization were observed.

What is claimed is:

1. A method of converting a photographic composition gel to a photographic composition sol comprising the steps of:

(a) keeping the photographic composition gel in a light shielding dielectric container, (b) determining the thickness of the gel in said container, (c) determining a microwave frequency which is capable of penetrating the gel to a depth corresponding to said thickness, (d) placing the gel in said container in a dielectric heating apparatus which has means for generating the determined microwave frequency; and (e) irradiating the gel in said container with the determined microwave energy to heat the gel and melt it into a sol state.

2. The method of claim 1, wherein in the dielectric heating apparatus a plurality of microwave electrodes are arranged in parallel at an interval equal to the width of the container plus a minimum play gap which enables the container to be placed in between the electrodes.

3. The method of claim 1, wherein the volume of the photographic composition gel in said container is not less than 50 liter.

4. The method of claim 1, wherein the composition is heated in the light-shielding container.

5. A method for producing a photographic material comprising steps of:

(a) keeping a photographic composition gel in a light shielding dielectric container having a volume of not less than 50 liters, (b) determining the thickness of the gel in said container, (c) determining a microwave frequency which is capable of penetrating the gel to a depth corresponding to said thickness, (d) placing said gel in said container in a dielectric heating apparatus which has means for generating the determined microwave frequency, the generating means comprising a plurality of electrodes arranged in parallel at an interval which enables said container to be placed between said electrodes, (e) irradiating the gel in the container with the determined microwave frequency to heat the gel and melt it into a sol state, and (f) removing the container from the dielectric heating apparatus, wherein microwave frequency used to irradiate the gel provides a penetrability corresponding to the thickness of the gel measured in the direction between said electrodes and is determined according to the Formula $$D/2 = 3.32 \times 10^7/(f\sqrt{\epsilon r} \cdot \tan\delta)$$

wherein D represents the thickness of the gel, f represents the microwave frequency, $\epsilon r$ represents the dielectric constant of the gel, and tan $\delta$ represents the dielectric loss of the gel.

6. The method of claim 5, wherein the determined microwave frequency is not less than 2450 MHz and the thickness of the photographic composition gel in the direction between said electrodes is less than 2.5 cm.

7. The method of claim 5, wherein the thickness of the photographic composition gel in the direction between said electrodes is not less than 2.5 cm.

8. The method of claim 5, wherein the container is sized to have a thickness shorter than the other dimensions of the container.

9. The method of claim 9, wherein the electrodes are vertically installed in said heating apparatus.

10. The method of claim 5, wherein the determined microwave frequency is not less than 915 MHz and not more than 2450 MHz.

11. The method of claim 5, wherein the microwave frequency is 2450 MHz.

* * * * *